United States Patent [19]

Maier et al.

[11] Patent Number: 5,008,004

[45] **Date of Patent: * Apr. 16, 1991**

[54] AROMATICS EXTRACTION PROCESS HAVING IMPROVED WATER STRIPPER

[75] Inventors: William H. Maier, Hoffman Estates; Martin F. Bentham, Chicago, both of Ill.

[73] Assignee: UOP, Des Plaines, Ill.

[ * ] Notice: The portion of the term of this patent subsequent to Jan. 30, 2007 has been disclaimed.

[21] Appl. No.: 459,163

[22] Filed: Dec. 29, 1989

Related U.S. Application Data

[63] Continuation-in-part of Ser. No. 252,616, Oct. 3, 1988, Pat. No. 4,897,182.

[51] Int. Cl.[5] ..... C10G 21/28

[52] U.S. Cl. ..... 208/321

[58] Field of Search ..... 208/321

[56] References Cited

U.S. PATENT DOCUMENTS

| | | | |
|---|---|---|---|
| 3,179,708 | 4/1965 | Penisten | 208/321 |
| 3,551,327 | 12/1970 | Kelly et al. | 208/321 |
| 3,652,452 | 3/1972 | Eyermann | 208/321 |
| 3,864,244 | 2/1975 | Van Tassell | 208/321 |
| 3,864,245 | 2/1975 | Van Tassell | 208/321 |
| 4,046,675 | 9/1977 | Asselin | 208/321 |
| 4,048,062 | 9/1977 | Asselin | 208/321 |
| 4,058,454 | 11/1977 | Asselin | 208/321 |
| 4,693,810 | 9/1987 | Forte et al. | 208/321 |
| 4,781,820 | 11/1988 | Forte | 208/321 |
| 4,869,809 | 9/1989 | Sarna | 208/321 |
| 4,897,182 | 1/1990 | Maier et al. | 208/321 |

*Primary Examiner*—Curtis R. Davis

*Attorney, Agent, or Firm*—Thomas K. McBride; John G. Tolomei

[57] ABSTRACT

Processes are disclosed for the recovery of aromatic extraction solvent from the raffinate phase of aromatic extraction processes. The raffinate phase is washed with water that is obtained in part by condensing a portion of the steam generated for stripping aromatics from the extract phase. The remaining portion of the raffinate wash water is provided by steam from a steam generation zone. The processes are especially useful when the feed contains relatively large amounts of non-aromatics and therefore produces a large raffinate stream. Disclosed solvents include sulfolane-type solvents, polyalkylene glycols, glycol ethers and mixtures thereof.

16 Claims, 1 Drawing Sheet

AROMATICS EXTRACTION PROCESS HAVING IMPROVED WATER STRIPPER

CROSS-REFERENCE TO RELATED APPLICATION

This application is a continuation-in-part of copending application Ser. No. 252,616, filed Oct. 3, 1988, now U.S. Pat. No. 4,897,182, issued Jan. 30, 1990, hereby incorporated by reference.

FIELD OF THE INVENTION

The present invention relates generally to aromatics extraction processes, which separate aromatics from mixed hydrocarbon feedstocks using aromatic extraction solvents and more particularly to processes which extract aromatics from feeds having from about 15–90% non-aromatics.

BACKGROUND OF THE INVENTION

Conventional processes for the recovery of high purity aromatic hydrocarbons such as benzene, toluene and xylenes (BTX) from various hydrocarbon feedstocks including catalytic reformate, hydrogenated pyrolysis gasoline, etc., utilize an aromatic selective solvent. Typically, in the practice of such processes, a hydrocarbon feed mixture is contacted in an extraction zone with an aromatic extraction solvent which selectively extracts the aromatic components from the hydrocarbon feedstock, thereby forming a raffinate phase comprising one or more non-aromatic hydrocarbons, and an extract phase comprising solvent having aromatic components dissolved therein.

The aromatic hydrocarbons are typically recovered from the extract phase, i.e., separated from the aromatic extraction solvent and water, by one or more distillation steps. Often, steam distillation is employed to assist in recovering the aromatic hydrocarbons from the solvent.

In contrast, the raffinate phase from the extraction zone is typically purified by water-washing. Often, the water used for washing the raffinate phase is obtained from the aqueous phase of an overhead, or side-draw, distillate from the extract phase distillation columns, i.e., condensed steam. The aqueous phase, which has low levels of solvent, is passed to one or more raffinate wash columns where residual aromatic extraction solvent is recovered from the raffinate phase. Spent raffinate wash water is passed to a steam generator along with any other solvent-containing water streams that may be present in the process to provide relatively pure steam which is recirculated to the extract phase distillation columns.

One process exemplary of the above-described water washing technique is described in U.S. Pat. No. 4,058,454. The patent discloses a solvent extraction process for separating polar hydrocarbons from non-polar hydrocarbons. The solvent-rich extract phase from the extraction zone is introduced into a stripping column. The stripper bottoms, being a polar hydrocarbon-containing, first solvent-rich stream, is introduced into an upper portion of a solvent recovery column. A vaporous stripping medium is introduced into a lower portion of the solvent recovery column. The stripping medium, i.e., water, is condensed in an overhead condensor and used as raffinate wash water.

Another process disclosed in U.S. Pat. No. 3,864,244 employs a steam generator to supply stripping steam but uses only one distillation column to separate non-aromatics from aromatics and from extraction solvent. The stripping steam is condensed with the aromatics product (drawn as a sidestream) and after phase separation is sent to the wash column. A portion of the steam passes overhead in the distillation column and is condensed with the non-aromatics. The aqueous phase of the overhead condensate is combined with the spent raffinate wash water and vaporized to generate stripping steam for the aromatics distillation. The process relates to the contacting of the spent raffinate wash water with a portion of the aromatics product to remove the non-aromatic contaminants before steam is generated.

U.S. Pat. No. 4,693,810 discloses a process wherein stripping water obtained from the steam distillation column is divided into two portions. One portion is passed to a steam generator. Another portion is vaporized by heat exchange with the lean solvent bottoms from the steam distillation column to vaporize the stripping water. The two portions are then combined and introduced as stripping steam into the steam distillation column.

It has been found that when a relatively lean feed is extracted, i.e., contains a large amount of non-aromatics, that water flowschemes such as described above can be inadequate. A large non-aromatic raffinate phase requires an unusually large amount of wash water. In the conventional process, the wash water is provided from the stripping steam, but when more water is needed than steam is required for stripping, operation of the column in this manner can be inadequate.

Accordingly, processes are sought which can provide for the recovery of extraction solvent from the raffinate phase from aromatic extraction processes when the raffinate phase is large in comparison to the extract phase, i.e., when the feed is lean in aromatic hydrocarbons.

SUMMARY OF THE INVENTION

A process is provided for the recovery of aromatic extraction solvent from the raffinate phase of an aromatic extraction process. The process utilizes a wash water stream to recover the solvent from the raffinate phase and are particularly useful when the feed stream to the aromatics extraction process has a high non-aromatic content, preferably, from about 55–90 volume percent. Spent raffinate wash water is regenerated in a steam generation zone to provide steam. A portion of the generated steam is used in a steam distillation zone for recovery and purification of the aromatic hydrocarbons. Another portion is condensed and utilized to provide a portion of the wash water stream. Hence, by virtue of the present invention, it is now possible to reduce the steam flow through the steam distillation zone, yet provide an adequate supply of wash water to recover aromatic extraction solvent from the raffinate phase.

In one aspect of the invention there is provided a process for the recovery of an aromatic extraction solvent from a raffinate phase, containing non-aromatic hydrocarbons and aromatic extraction solvent of an extraction zone of an aromatics extraction process. The recovery process includes the steps of contacting the raffinate phase with a wash water stream in a water-washing zone and recovering a raffinate product stream and a spent raffinate wash water stream containing water and aromatic extraction solvent; passing the spent raffinate wash water stream to a steam generation zone to provide steam and a lean solvent stream comprising aromatic extraction solvent; contacting a process stream comprising aromatic hydrocarbons and the aromatic extraction solvent with a first portion of the generated steam in a steam distillation zone to provide a bottoms stream comprising said aromatic extraction solvent, and at least one of an overhead or a side-cut comprising an aqueous phase and a hydrocarbon phase comprising aromatic hydrocarbons; condensing a second portion of the generated steam and recycling a portion of the second portion to provide reflux in the steam generation zone; and combining the aqueous phase with the remaining portion of the second portion to provide the wash water stream.

In another specific aspect of the present invention, there is provided a process for the extraction of aromatics from a feed containing both aromatic and non-aromatic hydrocarbons. The process includes the steps of (a) contacting the feed with an aromatics extraction solvent comprising a polyalkylene glycol of the formula:

$$HO—[CHR_1—(CH_2R_3)_n—O—]_mH$$

wherein n is an integer from 1 to 5, m is an integer having a value of 1 or greater and $R_1$, $R_2$ and $R_3$ may each be hydrogen, alkyl, aryl, aralkyl, alkylaryl and mixtures thereof and a glycol ether of the formula:

$$R_4O—[CHR_5—(CHR_6)_xO]_y—R_7$$

wherein $R_4$, $R_5$, $R_6$ and $R_7$ may each be hydrogen, alkyl, aryl, aralkyl, alkylaryl and mixtures thereof with the proviso that $R_4$ and $R_7$ are not both hydrogen; x is an integer from 1 to 5; and y may be an integer from 2 to 10; to provide a raffinate phase comprising non-aromatic hydrocarbons and an extract phase comprising substantially all of the aromatic hydrocarbons and a minor fraction of the non-aromatic hydrocarbons; (b) washing the raffinate phase of (a) with a wash water stream; (c) stripping the non-aromatic hydrocarbons from the extract phase of (a), condensing and returning the stripped non-aromatic hydrocarbons to the extraction of (a) (and condensing and phase separating the steam containing stripped hydrocarbons of (g) below); (d) recovering the aromatic hydrocarbons from the stripped extract from (c) by steam stripping and condensing and phase separating the stripped aromatics and steam; (e) recycling the condensed steam of (d) as the wash water stream to (b); (f) separating the wash water stream after contact with the raffinate in (b) and supplying the water stream as feed to a stripping steam generator in combination with the phase separated condensed steam of (c); (g) stripping residual hydrocarbons from the stripping steam generator feed with steam at the entrance to the steam generator and combining the stripped hydrocarbons and steam with the stripped non-aromatic hydrocarbons of (c); (h) generating steam in the steam generator of (f) and using a portion of said steam in (d); (i) condensing a portion of the steam generated in (h) and returning a portion of the condensate as reflux to purify the condensed water; and, (j) sending the remaining portion of the condensate of (i) to the wash step of (b) in combination with the condensed steam of (e).

DETAILED DESCRIPTION OF THE INVENTION

Figure 1:
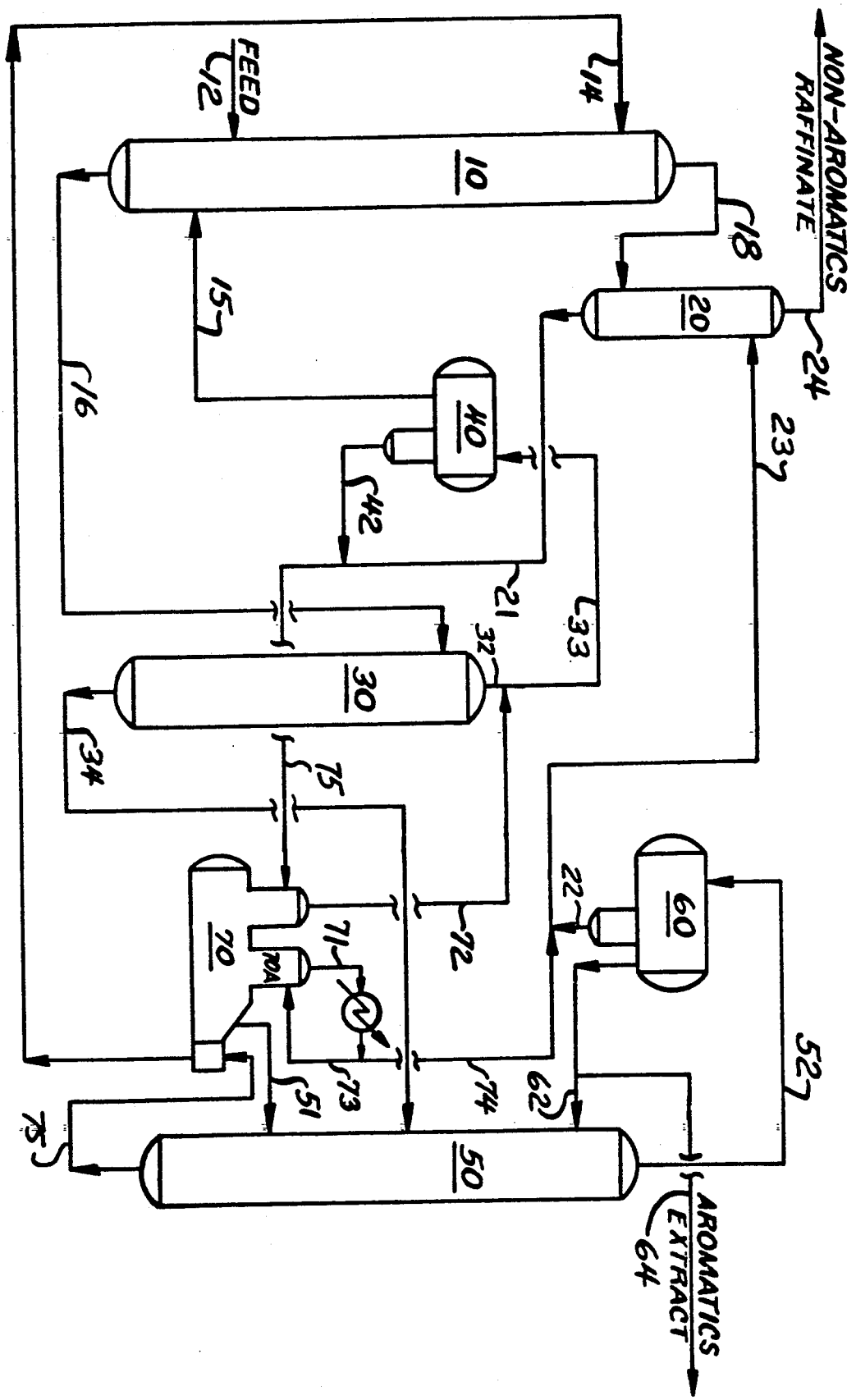
FIG. 1 illustrates a process flow diagram of a process for extracting aromatic hydrocarbons.

Hydrocarbon feedstocks suitable for utilization in the process of the present invention include many different aromatic-non-aromatic mixtures having a substantially high enough concentration of aromatic hydrocarbons to economically justify the recovery of the aromatic hydrocarbons as a separate product stream. Generally, the present invention is applicable to hydrocarbon feed mixtures containing from about 15–90% by weight non-aromatic hydrocarbons. Typical aromatic feedstock charged to the extraction zone of the present invention will contain from about 55–90 vol. % non-aromatic hydrocarbons with non-aromatic hydrocarbon concentrations as high as 95% being suitable in some instances. A suitable carbon range for the hydrocarbon feedstock is from about 5 carbon atoms per molecule to about 20 carbon atoms per molecule, and preferably from 5 to 10 carbon atoms per molecule.

One suitable source of hydrocarbon feedstock is a depentanized fraction from the effluent from a conventional catalytic reforming process unit for the reforming of a naphtha feedstock. Another suitable source of feedstock is the liquid by-product from a pyrolysis gasoline unit which has been hydrotreated to saturate olefins and diolefins, thereby producing an aromatic hydrocarbon concentrate suitable for the solvent extract technique described herein.

Still another suitable feed stream is a lube oil fraction such as a light distillate to heavy distillate, brigh stock, etc., which have boiling points between about 400° and about 1200° F. The aromatic hydrocarbons present in heavy hydrocarbon feeds, e.g., lubricating oils, generally include: alkylbenzenes, indenes, tetralins, indenes, naphthalenes, fluorenes, acenaphthalenes, biphenyls, phenanltrenes, anthracenes, discenaphthalenes, pyrenes, chripenes, diaceanthrancenes, benzyprenes and other various aromatic feed components.

A preferred feedstock for use in the present invention is one recovered from a catalytic reforming unit, comprises single ring aromatic hydrocarbons of the $C_6$–$C_9$ range which are also mixed with corresponding boiling range paraffins and naphthenes which are present in the product from a catalytic reforming unit.

Solvent compositions which may be utilized in the practice of the present invention are those selected from the classes which have high selectivity for aromatic hydrocarbons. These aromatic selective solvents generally contain one or more organic compounds containing in their molecule at least one polar group, such as a hydroxyl, amino, cyano, carboxyl or nitro radical. In order to be effective, the organic compounds of the solvent composition having the polar radical should have a boiling point greater than the boiling point of water when water is included in the solvent composition for enhancing its selectivity. In general, the aromatic extraction solvent should also have a boiling point greater than the end boiling point of the aromatic component to be extracted from the hydrocarbon feed mixture.

Organic compounds suitable for use as part of the solvent composition are preferably selected from the group of those organic-containing compounds which include the aliphatic and cyclic alcohols, cyclic monomeric sulfones, the glycols and glycol ethers, as well as the glycol esters and glycol ether esters. The mono- and poly-alkylene glycols in which the alkylene group contains from 2 to 4 carbon atoms, such as ethylene glycol, diethylene glycol, triethylene glycol, and tetraethylene glycol, propylene glycol, dipropylene glycol, and tripropylene glycol, as well as the methyl, ethyl, propyl and butyl ethers of the glycol hydroxyl groups and the acetic acid esters thereof, constitute a satisfactory class of organic solvents useful in admixture with water as the solvent composition for use in the present invention.

Some of these solvents, when combined with other cosolvents, can provide mixed extraction solvents having desirable properties. When such mixed solvents are utilized, the preferred solvents are the low molecular weight polyalkylene glycols of the formula:

$$HO-[CHR_1-(CHR_2R_3)_n-O]_m-H$$

wherein n is an integer from 1 to 5 and is preferably the integer of 1 or 2; m is an integer having a value of 1 or greater, preferably between about 2 to about 20 and most preferably between about 3 and about 8; and wherein $R_1$, $R_2$ and $R_3$ may be hydrogen, alkyl, aryl, aralkyl or alkylaryl and are preferably hydrogen and alkyl having between 1 and about 10 carbon atoms and most preferably are hydrogen. Examples of the polyalkylene glycol solvents employable herein are diethylene glycol, triethylene glycol, 1,3-butylene glycol, 1,2-butylene glycol, 1,5-pentaethylene glycol, and mixtures thereof and the like. Preferred solvents are diethylene glycol, triethylene glycol, tetraethylene glycol being most preferred. When a "cosolvent" component is employed herein such is preferably a glycol ether of the formula:

$$R_4O-[CH_5-(CHR_6-)-_xO]_y-R_7$$

wherein $R_4$, $R_5$, $R_6$ and $R_7$ may be hydrogen alkyl, aryl, aralkyl, alkylaryl and mixtures thereof with the proviso that $R_4$ or $R_7$ are not both hydrogen. The value of x is an integer from 1 to 5, preferably 1 or 2 and y may be an integer from 1 to 10 and is preferably from 2 to 7, and most preferably from 2 to 5. $R_4$, $R_5$, $R_6$ and $R_7$ are preferably selected from the group consisting of hydrogen and alkyl having 1 to about 10 carbons with the proviso that $R_4$ and $R_7$ may not both be hydrogen and most preferably $R_4$ is alkyl having from 1 to 5 carbons and $R_5$, $R_6$ and $R_7$ are hydrogen. The mixture(s) of solvent and cosolvent is selected such that at least one solvent and one cosolvent are provided to form the mixed extraction solvent. The cosolvent generally comprises between about 0.1 and about 99 percent of the mixed extraction solvent, preferably between about 0.5 and about 80 percent and more preferably between about 5 and about 60 percent by weight based on the total weight of the mixed extraction solvent. The above-described mixed extraction solvents are fully disclosed in U.S. Pat. No. 4,498,980, hereby incorporated by reference.

Another typical aromatics-selective solvent utilized in commercial aromatic extraction processes which can be recovered in accordance with the practice of this invention, is commonly referred to as sulfolane (tetrahydrothiphene,1-1 dioxide). Also employed are those sulfolane derivatives corresponding to the structural formula:

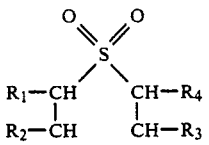

wherein $R_1$, $R_2$, $R_3$ and $R_4$ are independently selected from the group consisting of hydrogen, an alkyl radical containing from about 1 to about 10 carbon atoms, an aralkyl radical having from about 7 to about 12 carbon atoms, and an alkoxy radical having from about 1 to about 8 carbon atoms. Other solvents which may be included within this process are the sulfolenes, such as 2-sulfolene or 3-sulfolene which have the following structures:

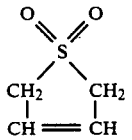

Other typical solvents which have a high selectivity for separating aromatics from non-aromatic hydrocarbons and which may be processed within the scope of the present invention are 2-methylsulfolane, 2,4-dimethylsulfolane, methyl-2-sulfonyl ether, N-aryl-3-sulfonylamine, 2-sulfonyl acetate, dimethylsulfoxide, N-methyl pyrrolidone, etc.

A particularly preferred solvent of the above-described sulfolane type has the following structural formula:

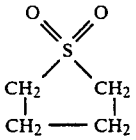

The aromatic selectivity of the solvent can usually be enhanced by the addition of water to the solvent. Preferably, the solvents utilized in the practice of this invention contain small quantities of water in order to increase the selectivity of the overall solvent phase for aromatic hydrocarbons without reducing substantially the solubility of the solvent for aromatic hydrocarbons. Accordingly, the solvent composition of the present invention preferably contains from about 0.1% to about 20% by weight water and, preferably, about 0.5 to about 10% by weight depending upon the particular solvent utilized and the process conditions at which the extraction zone and the extractor-stripper are operated.

Aromatic hydrocarbons contained in the foregoing feedstocks are recovered by introducing the hydrocarbon feedstock into a solvent extraction zone maintained under solvent extraction conditions including the presence of an aromatic selective solvent of the type discussed. Solvent extraction conditions and techniques are generally well known to those trained in the art and vary, depending on the particular aromatic selective solvent utilized. Generally, the solvent extraction zone is operated under conventional conditions including elevated temperature and a sufficiently elevated pressure to maintain the solvent reflux and hydrocarbon charge stream in the liquid phase. When utilizing a solvent such as sulfolane, suitable temperatures are about 80° to about 400° F., preferably about 175° to about 300° F., and suitable pressures are about atmospheric to about 400 psig, preferably about 50 to 150 psig. Solvent quantities should be sufficient to dissolve substantially all of the aromatic hydrocarbons present in the hydrocarbon feed to the extraction zone. Preferred are solvent to feed ratios, by volume of about 2:1 to about 10:1 when utilizing a $C_6$–$C_9$ range naphtha cut as feed.

In the operation of the solvent extraction zone, heavier non-aromatic hydrocarbons are displaced from the extract phase at the lower end of the solvent extraction zone by utilizing the known technique of recycling hydrocarbons from the overhead of the stripping column as reflux to the extraction zone. By displacing the heavy non-aromatics with light non-aromatics, the resulting non-aromatics are more readily separable from the aromatics in the subsequent stripping zone to be discussed later. It is preferred that this reflux stream comprise relatively light non-aromatic hydrocarbons but significant quantities of aromatic hydrocarbons, i.e., 30 to 60% by weight, may be present in the reflux stream. The exact amount of reflux introduced into the lower section of the solvent extraction zone varies depending on the degree of non-aromatic hydrocarbon rejection desired in the extraction zone. Preferably, the reflux is at least 10% by volume of the extract phase so as to insure effective displacement of the heavy non-aromatic hydrocarbons from the extract phase into the raffinate. According to the process of the present invention, at least a portion, if not all, of the light non-aromatic reflux is provided by a non-aromatic fraction removed as overhead from an upper section of a hereinafter described distillation zone. This fraction is withdrawn as a vapor and contains water (steam) which is preferably condensed and removed before the non-aromatics are passed as reflux to the solvent extraction zone.

The solvent extraction zone provides an extract phase comprising solvent having aromatic hydrocarbons and a minor amount of non-aromatic hydrocarbons dissolved therein and a raffinate phase comprising non-aromatic hydrocarbons. As hereinbefore noted, the extract phase is separated into an aromatic product stream and a lean solvent stream by one or more distillation steps, at least one of which utilizing steam distillation.

A process using a single distillation zone for purifying the extract phase is set forth in U.S. Pat. No. 4,693,810, hereby incorporated by reference. The products from the distillation zone include an overhead stream comprising non-aromatic hydrocarbons, i.e., reflux and water, a side-cut stream comprising aromatic hydrocarbons and water and a bottoms stream comprising aromatic extraction solvent. Typically, the temperature at the top of the distillation zone, which, in terms of the apparatus used, may be referred to as a distillation column or stripping column, is at the boiling point of the mixture of aromatics present in the zone while the temperature at the bottom of the stripper is generally in the range of about 275° to about 400° F. At the top of the distillation zone there is an upper flash zone which is maintained at a pressure in the range of about 20 to about 45 psig. In a lower flash zone just beneath the upper flash zone and connected thereto, the pressure is in the range of about 0 to about 25 psig and is about 10 to 20 psig lower than the pressure in the upper flash zone. The pressure in the rest of the distillation zone is maintained in the range of about 5 to about 25 psig with some variation throughout the zone. The steam or steam/water mixture brought into the bottom of the distillation zone enters at a temperature of about 212° to about 300° C. and is under a pressure of about 5 to about 25 psig. The total water and/or steam injected into the distillation column is in the range of about 0.1 part to about 0.5 part by weight of water to one part by weight of aromatics in the zone and preferably in the range of about 0.1 part to about 0.3 part by weight of water to one part by weight of aromatics.

A process using two distillation zones for purifying the extract phase is set forth in U.S. Pat. No. 4,058,454. In the first zone, i.e., stripping column, non-aromatic hydrocarbons, i.e., extractor reflux hydrocarbons, are recovered as an overhead stream and a bottoms stream comprising aromatic hydrocarbons and aromatic extraction solvent is recovered. The stripping column is generally maintained at moderate pressures and sufficiently high temperatures to produce an overhead stream containing all the non-aromatic hydrocarbons. Generally, pressures are in the range of about atmospheric to about 50 psig although the pressure at the top of the stripping column is typically maintained at a level of about 5.0 psig to about 20.0 psig at the bottom. Suitable operating temperatures are within the range of about 225°–400° F. The bottoms stream from the first zone is passed to the second zone, i.e., recovery column, where the aromatic product is recovered as an overhead stream along with condensed steam and the aromatic extraction solvent is recovered as lean solvent bottoms by utilizing steam distillation. Typically, solvent recovery is effected at temperatures ranging from about 130° to about 375° F. and function at a pressure less than 1.0 atmospheres, and preferably, at a level of about 80 mm. Hg., absolute to about 700 mm. Hg., absolute.

The raffinate phase from the extraction zone is treated in accordance with the present invention by water washing with a wash water stream. The water washing zone is typically maintained at a relatively low pressure of about 30 to about 75 psig. Moderate temperatures are also employed, and will range from about 70° to about 130° F. The apparatus utilized in the water washing zone typically comprises one or more contacting stages and may be packed with trays, rings, saddles or other suitable packing material known in the art.

The process of the present invention is hereinafter described with reference to the drawing. Miscellaneous appurtenances, not believed required by those possessing the requisite expertise in the appropriate art, have been eliminated from the drawing. The use of details such as pumps, compressors, controls and instrumentation, heat-recovery circuits, valving, condensers and coolers, start-up lines and similar hardware, etc., is well within the purview of those skilled in the art. It is understood that the illustration as presented is not intended to limit my invention beyond the scope and spirit of the appended claims.

With reference to the FIG. 1, feedstock 12 is supplied at a point above the bottom of an extraction column 10 which may be a rotating disc contactor, or a column using trays, packing or the like. A lean solvent stream 14 is passed countercurrently to the feed. The solvent stream will consist primarily of the extracting solvent, e.g., tetraethylene glycol/methoxy triglycol mixed extraction solvent, but including also minor amounts of water and any residual hydrocarbons which are not removed in the recovery column 50. The solvent enters the top of the extraction column 10 and passes downward while contacting the feedstream so that at the bottom of column 10 what was previously termed a lean solvent has become aromatics-rich solvent 16. The hydrocarbon concentration in the solvent may be quite substantial, and typically is in the range of 15–45 vol. %.

The feedstream gives up its aromatics as it passes upward against the downflowing solvent and at the top of the column substantially only non-aromatic compounds remain. However, they will contain a small amount of solvent which should be recovered. Consequently, the non-aromatic stream 18 is scrubbed in raffinate water wash column 20 countercurrently against a circulating stream of water 23 the source of which is hereinafter described. The scrubbed product stream 24 is termed the raffinate. It comprises substantially all of the non-aromatic compounds introduced with the feed with very little residual solvent, say 5 ppm, and substantially no aromatic compounds when the process is operated efficiently.

Another stream 15, the source of which is hereinafter described, enters near the bottom of the extraction column 10. It is a recirculating stream which contains a substantial fraction of aromatics but more importantly, contains non-aromatic compounds which are purged from the aromatics-rich solvent in stripper 30 in order to avoid contaminating the aromatics product 64. This stream 15 is introduced toward the bottom of column 10 where it displaces the heavier non-aromatic components so that they pass up the column and out with the raffinate stream 24.

The aromatics-rich solvent 16 is passed to a reboiled stripping column 30 where the minor amounts of non-aromatic compounds which are present in the aromatics-rich extract are rejected. Stripping column 30 is important in maintaining the purity of the aromatics product 64, which often must be above 99 percent aromatics. In order to remove the minor amounts of non-aromatics, it is necessary to remove overhead a portion of the lighter aromatics, particularly benzene, as well. The overhead vapor stream 32 from stripping column 30 is cooled and condensed and phase-separated in vessel 40. The hydrocarbons are recycled as stream 15 to the extraction column 10 as previously mentioned. Since water is present in the solvent as it enters the extractor, water also appears in the overhead vapor 32 of the stripping column 30 and when condensed separates from the hydrocarbons and returned via stream 42 to water-handling facilities hereinafter discussed.

The aromatics-rich solvent leaving as stream 34 from the bottom of the stripping column 30 now is substantially free of non-aromatic compounds and is ready for separation of the aromatics from the solvent which takes place by distillation in recovery column 50. Column 50 is reboiled to generate stripping vapor and the overhead vapor 52 is condensed. A portion of the condensate is drawn off as the aromatics extract product 64. A portion of the hydrocarbon condensate is returned as reflux 62 to the column to maintain the desired degree of separation of aromatics from solvent. In addition, water present in overhead vapor 52 is condensed to liquid water which is separated in vessel 60 and then returned to the raffinate water wash column 20 via stream 22 and 23 as a means of removing trace solvent from the raffinate as previously explained. Stripping steam 51 is introduced toward the bottom of the column 50 in order to strip out the aromatics and to reduce the solubility of hydrocarbons in the solvent and consequently to lower their concentration in the lean solvent which is to be reused for extraction. The steam is generated from water obtained from two sources, the first being the water 21 leaving the raffinate water wash column 20. The second is the water condensed and separated from the stripper overhead 42. These two streams will contain a minor amount of hydrocarbons. In order to avoid contamination of the solvent, the combined water streams 75 are stripped in water stripper 70 to provide an essentially hydrocarbon-free water for use as stripping steam 51 in the recovery column 50. The hydrocarbons recovered 72 are combined with the stripper overhead 32 to create stream 33.

It can be seen that the overall process is one in which a mixed hydrocarbon feedstock 12 containing significant amounts of aromatic hydrocarbons is split into a non-aromatic raffinate 24 and an aromatic hydrocarbon extract 64. The solvent circulates from the extraction column 10 to the stripping column 30, then to the recovery column 50, and back to extraction column 10 again. Since most of the solvents described above are particularly stable under the conditions used in this process only a minor purge is required in order to rid the stream of any buildup of heavy compounds or degradation products. This is not shown in the flowsheet since it is only incidental to the process of the invention. Water also circulates continuously through the process, being used to wash the raffinate free of solvent in column 20 and to supply stripping vapor for use in recovery column 50 to remove hydrocarbons from the solvent before it is reused in extraction column 10.

When the feedstream 12 contains a relatively large amount of non-aromatics, e.g., 55–90 volume %, the raffinate stream 18 is much larger and wash water stream 23 must be increased to assure complete removal of the solvent. In the usual process this wash water is obtained by phase-separating the condensed overhead vapor 52 from the product recovery column 50 as previously described. When the aromatic content of the feed is relatively low, the increased demand for wash water 23 exceeds the need for stripping stream 51 to purify the solvent before reuse. Increasing the stripping stream also would require greater reflux 62 to column 50 especially where the product contains a large amount of benzene in order to avoid condensation of water on the trays. In the present invention, a portion of the wash water 23 is obtained by withdrawing steam 71 from the steam generator 70 after contacting a water reflux stream 73 in contacting section **70*a*. The withdrawn steam is condensed and part of the water is returned as reflux 73 and a portion 74 is combined with water 22 from drum 60 to create stream 23 and to augment the supply of wash water for use in wash column 20**.

The wash water must be relatively free of solvent and consequently a reflux to steam ratio 73/71 of about 0.03 to 0.6 is used. The contacting section **70*a*** may be packed with suitable packing materials such as rings, saddles, etc. known to those skilled in the art or alternatively trays or other familiar contacting devices may be employed.

Contacting section **70*a* functions at a top temperature of about 230° F. a top pressure of about 6.0 psig, a bottom temperature of about 250° F. and a bottom pressure of about 7.0 psig. Heat in-put to contacting section 70*a* is supplied by way of indirect heat-exchange with at least a portion, if not all of the lean solvent, in line 75, from recovery column 50. Stripping vapors, as hereinbefore described, are withdrawn through line 51 and at least a portion thereof is introduced thereby into recovery column 50** through a lower intermediate locus thereof.

What is claimed is:

1. A process for the recovery of an aromatic extraction solvent from a raffinate phase containing non-aromatic hydrocarbons and said aromatic extraction solvent of an extraction zone of an aromatics extraction process, said process comprising;

(a) contacting the raffinate phase with a wash water stream in a water-washing zone and recovering a raffinate product stream and a spent raffinate wash water stream comprising water and said aromatic extraction solvent;

(b) passing the spent raffinate wash water stream to a steam generation zone to provide steam and a lean solvent stream comprising said aromatic extraction solvent;

(c) contacting a process stream comprising aromatic hydrocarbons and said aromatic extraction solvent with a first portion of said steam in a steam distillation zone to provide a bottoms stream comprising said aromatic extraction solvent, and at least one of an overhead or a side-cut comprising an aqueous phase and a hydrocarbon phase comprising aromatic hydrocarbons;

(d) condensing a second portion of said steam and recycling a portion of said second portion to provide reflux in said steam generation zone; and (e) combining said aqueous phase with the remaining portion of said second portion to provide said wash water stream.

2. The process of claim 1 further comprising withdrawing an extract phase containing aromatic hydrocarbons, non-aromatic hydrocarbons and said aromatic extraction solvent from said extraction zone.

3. The process of claim 2 comprising separating said extract phase into a recycle stream containing said non-aromatic hydrocarbons and said process stream comprising aromatic hydrocarbons and said aromatic extraction solvent.

4. The method of claim 1 wherein said aromatic extraction solvent comprises a polyalkene glycol.

5. The method of claim 4 wherein said aromatic extraction solvent comprises tetraethylene glycol.

6. The method of claim 1 wherein said aromatic extraction solvent comprises a polyalkylene glycol of the formula:

$$HO—[CHR_1—(CH_2R_3)_n—O—]_mH$$

wherein n is an integer from 1 to 5, m is an integer having a value of 1 or greater and $R_1$, $R_2$ and $R_3$ may each be hydrogen, alkyl, aryl, aralkyl, alkylaryl and mixtures thereof and a glycol ether of the formula:

$$R_4O—[CHR_5—(CHR_6)_xO]_y—R_7$$

wherein $R_4$, $R_5$, $R_6$ and $R_7$ may each be hydrogen, alkyl, aryl, aralkyl, alkylaryl and mixtures thereof with the proviso that $R_4$ and $R_7$ are not both hydrogen; x is an integer from 1 to 5; and y may be an integer from 2 to 10.

7. The method of claim 6 wherein said aromatic extraction solvent consists essentially of a polyalkylene glycol selected from the class consisting of diethylene glycol, triethylene glycol, tetraethylene glycol and mixtures thereof and a glycol ether selected from the class consisting of methyoxytriglycol, ethoxytriglycol, butoxytriglycol, methoxytetraglycol and ethoxytetraglycol and mixtures thereof wherein the glycol ether comprises between about 0.1 and 99 percentage by weight of the mixed extraction solvent.

8. The process of claim 7 wherein the polyalkylene glycol is tetraethylene glycol and the glycol ether is methoxytriglycol.

9. The method of claim 1 wherein said aromatic selective solvent comprises a sulfolane-type solvent.

10. In an aromatic extraction process for the extraction of aromatic hydrocarbons from a feed comprising aromatic and non-aromatic hydrocarbons including the steps of: contacting the feed with an aromatic extraction solvent in an aromatic extraction zone to provide a raffinate phase containing said non-aromatic hydrocarbons and said aromatic extraction solvent and an extract phase containing said aromatic hydrocarbons and said aromatic extraction solvent, contacting the raffinate phase with a wash water stream in a water-washing zone and recovering a raffinate product stream and a spent raffinate wash water stream comprising said aromatic extraction solvent, and separating said aromatic extraction solvent from said aromatic hydrocarbons contained in the extract phase in a steam distillation zone to provide a bottoms product comprising said aromatic extraction solvent, and at least one of an overhead or a side-cut comprising an aqueous phase and a hydrocarbon phase comprising said aromatic hydrocarbons, the improvement which comprises:

(a) passing the spent raffinate wash water stream to a steam generation zone to provide steam and a lean solvent stream comprising said aromatic extraction solvent;

(b) passing a first portion of said steam to said steam distillation zone to provide stripping steam therefor;

(c) condensing a second portion of said steam and recycling a portion of said second portion to said steam generation zone as reflux;

(d) combining the remaining portion of said second portion with said aqueous phase to provide said wash water stream.

11. The process of claim 10 wherein the ratio of reflux to said second portion is from about 0.03 to 0.6.

12. A process for the extraction of aromatics from a feed containing both aromatic and non-aromatic hydrocarbons comprising:

(a) contacting said feed with an aromatics extraction solvent comprising a polyalkylene glycol of the formula:

$$HO—[CHR_1—(CH_2R_3)_n—O—]_mH$$

wherein n is an integer from 1 to 5, m is an integer having a value of 1 or greater and $R_1$, $R_2$ and $R_3$ may each be hydrogen, alkyl, aryl, aralkyl, alkylaryl and mixtures thereof and a glycol ether of the formula:

$$R_4O—[CHR_5—(CHR_6)_xO]_y—R_7$$

wherein $R_4$, $R_5$, $R_6$ and $R_7$ may each be hydrogen, alkyl, aryl, aralkyl, alkylaryl and mixtures thereof with the proviso that $R_4$ and $R_7$ are not both hydrogen; x is an integer from 1 to 5; and y may be an integer from 2 to 10; to provide a raffinate phase comprising non-aromatic hydrocarbons and an extract phase comprising substantially all of the aromatic hydrocarbons and a minor fraction of the non-aromatic hydrocarbons;

(b) washing the raffinate phase of (a) with a wash water stream;

(c) stripping the non-aromatic hydrocarbons from the extract phase of (a), condensing and returning said stripped non-aromatic hydrocarbons to the extraction of (a) and condensing and phase separating the steam containing stripped hydrocarbons of (g) below;

(d) recovering the aromatic hydrocarbons from the stripped extract from (c) by steam stripping and condensing and phase separating said stripped aromatics and steam;

(e) recycling said condensed steam of (d) as the wash water stream to (b);

(f) separating the wash water stream after contact with the raffinate in (b) and supplying said water stream as feed to a stripping steam generator in combination with the phase separated condensed steam of (c);

(g) stripping residual hydrocarbons from the stripping steam generator feed with steam at the entrance to the steam generator and combining said stripped hydrocarbons and steam with the stripped non-aromatic hydrocarbons of (c);

(h) generating steam in the steam generator of (f) and using a portion of said steam in (d);

(i) condensing a portion of the steam generated in (h) and returning a portion of the condensate as reflux to purify the condensed water; and, (j) sending the remaining portion of the condensate of (i) to the wash step of (b) in combination with the condensed steam of (e).

13. The method of claim 12 wherein said aromatic extraction solvent consists essentially of a polyalkylene glycol selected from the class consisting of diethylene glycol, triethylene glycol, tetraethylene glycol and mixtures thereof and a glycol ether selected from the class consisting of methyoxytriglycol, ethoxytriglycol, butoxytriglycol, methoxytetraglycol and ethoxytetraglycol and mixtures thereof wherein the glycol ether comprises between about 0.1 and 99 percentage by weight of the mixed extraction solvent.

14. The process of claim 13 wherein the polyalkylene glycol is tetraethylene glycol and the glycol ether is methoxytriglycol.

15. The process of claim 12 wherein the reflux to steam ratio in step (i) is about 0.03 to 0.6.

16. The process of claim 12 wherein said feed comprises from about 55 to 90 vol. % non-aromatic hydrocarbons.

* * * * *